United States Patent [19]

Fauser

[11] Patent Number: 4,560,860

[45] Date of Patent: Dec. 24, 1985

[54] HEATABLE ROLL

[75] Inventor: Hans Fauser, Heidenheim, Fed. Rep. of Germany

[73] Assignee: J. M. Voith GmbH, Heidenheim, Fed. Rep. of Germany

[21] Appl. No.: 683,151

[22] Filed: Dec. 18, 1984

[30] Foreign Application Priority Data

Jan. 3, 1984 [DE] Fed. Rep. of Germany ..... 3400087

[51] Int. Cl.[4] ..... H05B 1/02

[52] U.S. Cl. ..... 219/470; 219/471

[58] Field of Search ..... 219/216, 244, 388, 469, 219/470, 471, 530, 535, 540; 34/110

[56] References Cited

U.S. PATENT DOCUMENTS

| | | | |
|---|---|---|---|
| 2,777,931 | 1/1957 | Bimdegaard et al. | 219/470 |
| 3,177,799 | 4/1965 | Justus et al. | 15/256.51 X |
| 3,182,587 | 5/1965 | Woodhall | 29/110 X |
| 3,376,407 | 4/1968 | Wagner | 219/470 |
| 3,624,353 | 11/1971 | Bjorklund | 219/470 |
| 4,304,985 | 12/1981 | Miller | 219/216 |
| 4,307,501 | 12/1981 | Ahrweiler | 29/113 AD |
| 4,384,514 | 5/1983 | Larive et al. | 219/10.57 X |
| 4,425,489 | 1/1984 | Pav et al. | 219/471 |

*Primary Examiner*—Volodymyr Y. Mayewsky
*Attorney, Agent, or Firm*—Albert L. Jeffers; Stephen T. Belsheim

[57] ABSTRACT

A heatable roll has a plurality of annular, preferably electrical, heating elements (13) distributed internally along the length of the roll body (10,11). A slip-ring arrangement (22) rotating with the roll connects the heating elements with a heating current source (20) located outside the roll. A heating output setting device (9) arranged inside the roll is provided for each heating element and is connected to a signal transmitting arrangement (31 to 34). A control signal is formed for each heating element in a control center (21) located outside the roll, and is supplied to a parallel-serial converter (31). This converter forms one serial signal sequence from the plurality of parallel control signals, and this sequence is supplied, for example by means of slip-rings (**22*a*), to a serial-parallel converter (34**) located in the roll. This converter converts the serial signal sequence back again into parallel control signals which are supplied to the individual heating output setting devices.

9 Claims, 4 Drawing Figures

HEATABLE ROLL

The invention relates to a heatable roll of the kind comprising a tubular, rotatable roll body having a plurality of heating elements distributed internally along the length of the roll, a stationary heating-energy source located externally of the roll body and connected, via a connecting device, to a main lead disposed in the rotating roll body, each heating element being provided with its own heating output setting device rigidly fixed to the rotating roll body and connected to the main lead, for setting the heating output dependent upon the magnitude of an electrical control signal, and the heating output setting devices being connected to a signal transmitting arrangement for transmitting the control signals from a control centre located externally of the roll body to the rotating roll body.

Rolls of this kind are known from U.S. Pat. No. 3 182 587. One of the rolls described therein can be heated with a fluid, and the other can be heated by means of electrical resistance heating elements. The fluid heated roll (FIGS. 3 to 5) has a plurality of fluid chambers distributed internally along the length of the roll. A main conduit which rotates with the roll body and is common to all the fluid chambers is connected via a rotating coupling to an externally disposed stationary fluid supply conduit. A heating output setting device in the form of an electrically adjustable valve is provided for each of the fluid chambers. Each of these valves (which rotate with the roll body) is connected on one hand to the main conduit and on the other hand to one of the fluid chambers. Control of the valves is effected by means of electrical control signals. For this purpose a signal-transmitting device constructed as a slip-ring arrangement which transmits the control signals from outside to the rotatable roll body is provided. The other electrically-heated roll (FIG. 6) has a plurality of electrical resistance heating elements distributed along the length of the roll and a corresponding number of slip-rings to supply the electrical heating current. According to column 5, lines 33 to 39 and FIG. 7 of the U.S. Pat. No., this known roll can be adapted so that inside the rotatable roll body a heating output setting device to which a control signal from outside can be supplied via the respective slip-ring is provided for each electrical heating element. It is assumed that only two slip-rings (when alternating current is used) or three slip-rings (when rotary current is used) are required for the heating elements as a whole, and that smaller slip-rings can be used for transmitting the control signals than for the transmission of the heating current. It is common to both the known rolls that a separate slip-ring is required for each individual heating element. If these slip-rings are to transmit the heating current, very wide slip-rings with a considerable space requirement are needed. However, even when using relatively small slip-rings which have to transmit only the electric control signals, only a limited number of slip-rings can be arranged on the roll. Accordingly, the number of heating elements which can be independently controlled is also limited.

It is the object of the invention to develop the roll of the kind discussed above so that any number of independently controlled heating elements can be arranged in the roll.

According to the invention such a roll is characterised by the features set out in appended claim 1.

Thus, the invention uses the method known from U.S. Pat. 3,182,587, whereby the setting of the heating output of each individual heating element is effected inside the rotatable roll body. In fact, it is entirely possible to fit a relatively high number of heating output setting devices inside the roll body. This is particularly true when (in the case of an electrically heatable roll) electronic relays (e.g. load relays) are used, each of which is only slightly larger than a matchbox (see SIEMENS, Relay Data Book 1983/84, pages 36.1 to 36.11). In each instance, as indicated hereinbefore, these heating output setting devices are connected to a main heating energy lead inside the roll body, and are linked via a signal-transmitting device to a control centre located outside the roll. According to the main feature of the invention this signal transmitting device is now constructed as what is known as a serial signal channel. Here use is made of the method which is known per se of converting a plurality of different, parallel (ie. simultaneously formed) control signals into a so-called serial signal sequence. As a rule it will be possible to form a single serial signal sequence from the parallel control signals, so that only one single pair of lines is required for conducting the serial signal sequence further. However as will be explained in more detail later, it is also conceivable to produce a small number (e.g. eight) of serial signal sequences adjacent to each other and to provide each of these signal sequences with its own line.

Slip-rings or contact-free devices can again be used for transmitting the serial signal sequence (or the plurality of serial signal sequences) to the revolving roll. In either case a considerable advantage of the design according to the invention resides in the fact that an exceptionally high number of individual heating elements can be provided in the roll body, and that these can all be controlled independently of each other. Thus, it is possible, for example with a roll casing length of approximately 10 m, to arrange approximately 100 individual heating elements (preferably at equal intervals) inside the roll body. Despite this, due to the use of the serial signal technique, only a very few slip-rings (in the most favourable case only two) are required for the transmission of the control signals to the revolving roll body. If a device for the contact-free transmission of signals is used this is similarly very much simpler.

The basic principle of the serial signal technique is known per se from the book by Lesea/Zaks "Mikroprozessor Interface Techniken" 3rd Edition 1982, SYBEX-Verlag; original English publication: "Microprocessor Interfacing Techniques" from Sybex Inc., Berkeley, U.S.A. In the case of the invention, outside the roll body, for example in the stationary control centre, with the aid of a parallel-serial converter, at least one serial signal sequence is formed from the control signals formed adjacent to each other therein, and this sequence is transmitted to the revolving roll. There the serial signal sequence is converted back again into parallel control signals with the aid of a serial-parallel converter (working in the opposite direction) which rotates with the roll body, and these signals are supplied to the various heating output setting devices.

Contact-free signal transmission to the rotatable roll may be realised in various ways. For example, use may be made of optical or inductive or capacitive transmission devices. The known method of radio transmission may also be used.

The roll according to the invention may have application in, amongst other things, glazing units in paper machines, and also for the so-called hot glazing units, or for paper calenders, and also for the so-called super calenders, amongst others. If the roll is incorporated in a paper machine the distance between the heating elements and thus the length of the heated zones can be the same as the distance between the adjustment spindles of the pulp stock outlet of the paper machine.

In the applications referred to above, the roll according to the invention forms together with a counter-roll a pressing gap through which there runs the paper web which is to be processed. It is frequently necessary to even out the thickness of the paper web which is running through, across the width of the web (this is known as the transverse thickness profile), and a transverse thickness profile which is already uniform should be maintained as the paper web runs through the pressing gap. For this purpose, as is already known, it is necessary to vary the diameter of the roll in individual zones distributed across the width of the web by small amounts (in the magnitude of 1/1000 to 1/100 mm). Until now attempts have been made to achieve this by blowing air onto the surface of the roll which is thus cooled or heated differently over different zones (U.S. Pat. No. 3,177,799). A disadvantage of this method is that the diameter variations frequently cannot be obtained to the desired extent. Moreover, the supply of hot air creates a bad spatial climate.

Another known method of influencing the temperature of the roll casing in different zones uses a "magnetic field generator" for each zone, which induces an eddy current in the roll casing while the latter is rotating (U.S. Pat. No. 4,384,514). A disadvantage of this method is that forces are exerted on the roll casing which cause an undesirable deformation of this roll casing.

Attempts have also been made to influence the transverse thickness profile of paper webs using a so-called adjustable flection roll. The linear force distribution along the pressing gap is varied by bowing the roll casing in a specific fashion (DE-OS No. 30 03 395 = U.S. Pat. No. 4,307,501). A disadvantage of this method is that a change in the linear force is possible only over very broad zones. On the other hand, with the invention it is possible to obtain clear variations in the diameter (and thus also variations in the distribution of linear force) even within very narrow zones.

Further expedient development features of the invention are set out in subsidiary claims 5 to 9. With the relatively narrow construction of the heating elements according to claim 7 a clear variation of the roll diameter can be obtained over quite narrow zones along the length of the roll casing, if required. In other words: a considerable "differential" can be obtained between differently heated zones (and thus zones with different diameters). This effect can be further enhanced if cooling air-jet nozzles which are known per se are provided on the outside of the roll casing, in addition to the heating elements, as indicated in claim 8 or 9.

Embodiment examples of the invention are described in the following with reference to the drawings, in which.

Figure 1:
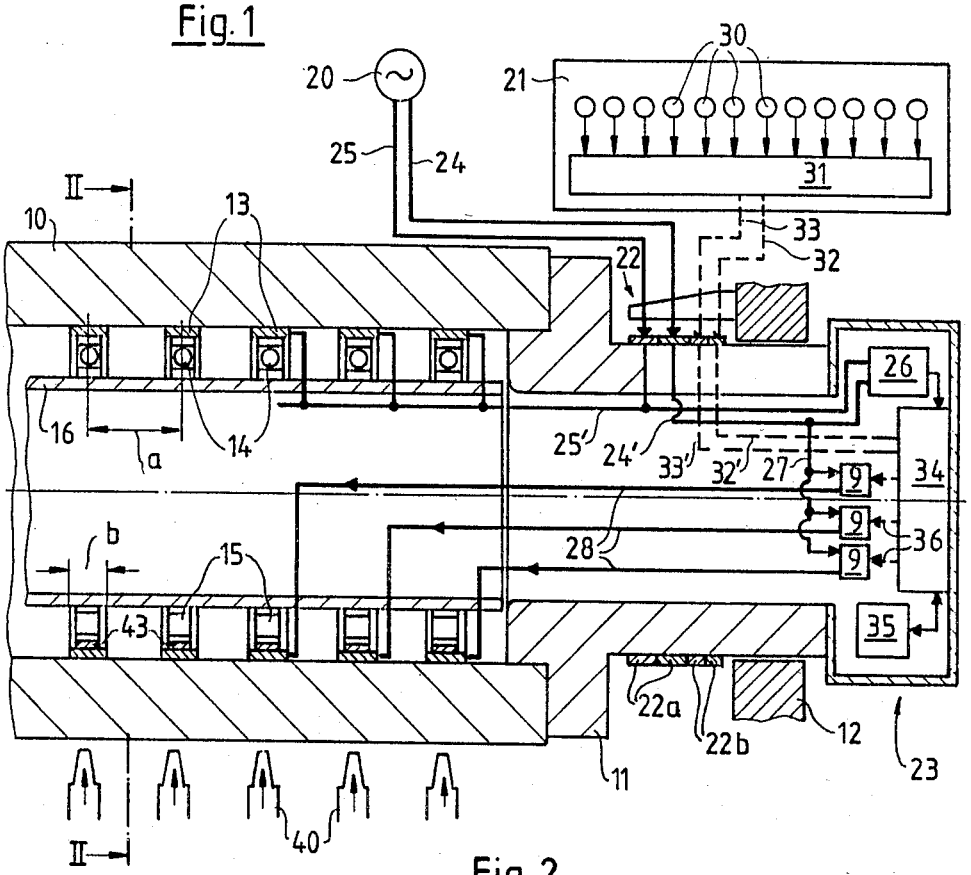
FIG. 1 shows a partial longitudinal section through one embodiment example of an electrically heatable roll.

According to FIG. 1 a rotatable roll body has a tubular roll casing 10 on the end of which a bearing journal 11 is fitted. A bearing 12 is shown only symbolically. At the other end of the roll body, which is not visible, there is again a bearing journal and a bearing.

Inside the roll casing a plurality of electrical heating elements 13 is provided, distributed along the length of the roll. These heating elements are constructed in the form of complete rings. Each of the heating elements is pressed against the internal surface of the roll casing 10 by means of an open (split) clamping ring 43, supplemented if required by the force of a spring 14. It may be necessary to make the annular heating elements 13 from a basic material which can be easily elastically deformed, e.g. from asbestos. Each clamping ring 43 is fixed, for example by means of a fixing 15, to a supporting tube 16 which extends concentrically through the inside of the roll body. The heating elements 13 and the clamping rings 43 can thus be fixed on the supporting tube 16 outside the roll body and then all inserted in the roll casing 10 together.

For the supply of current and for the control of the heating output of the heating elements 13, an alternating current source 20, a control centre 21 (which are both disposed outside the roll body), a slip-ring arrangement 22 disposed on the bearing journal 11, and an electronic control unit 23 which rotates with the roll body are provided. A pair of conductors 24, 25; 24', 25' connects the current source 20 with the interior of the roll body via two wide slip-rings **22*a*. A heating output setting device 9 is provided for each heating element 13. In the drawing (for the sake of clarity) only three of these are shown. They are all connected to the conductor 24' via the so-called main lead 27 for all the heating current. Each heating output setting device 9 is connected to the heating element 13 allotted to it via its own output lead 28. In addition, each heating element is connected to the return conductor 25'**.

In the control centre 21 a control signal can be formed for each heating element 13 (in the simplest case by means of a hand-operated setting device 30). Another possibility is for these control signals to be formed by means of a process controlling system appertaining to the paper machine. The control signals are converted into a serial signal sequence in a so-called parallel-serial converter 31. This sequence is supplied via the pair of conductors 32, 33; 32', 33' and via two narrow signal slip-rings **22*b* to a serial-parallel converter 34 to which a memory 35 is connected. Here the serial signals are converted back again into parallel control signals which are supplied via the lines 36 to the individual heating output setting devices 9. A power supply unit 26 which is connected to the alternating current source 20 via the conductors 24', 25' is used for supplying current to the electronic components 34, 35**.

Figure 2:
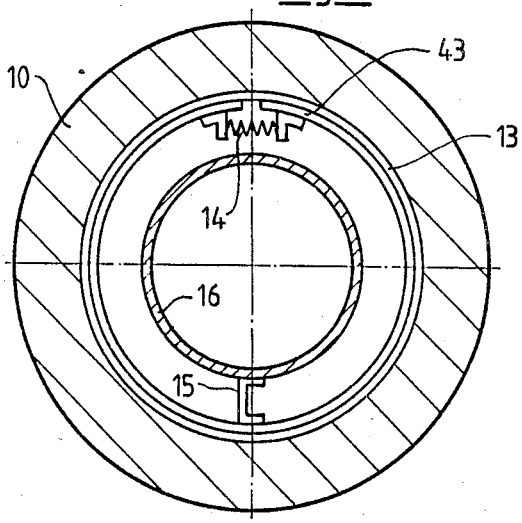
FIG. 2 shows a cross-section along the line II—II in FIG. 1.

If required, cooling air-jet nozzles 40 can be arranged on the outside of the roll casing 10. In FIG. 1 such a jet nozzle is shown schematically associated with each heating element 13. The jet nozzles (which are omitted in FIG. 2) are connected to an air-jet conduit (not visible) and can be switched on and off individually.

Figure 3:
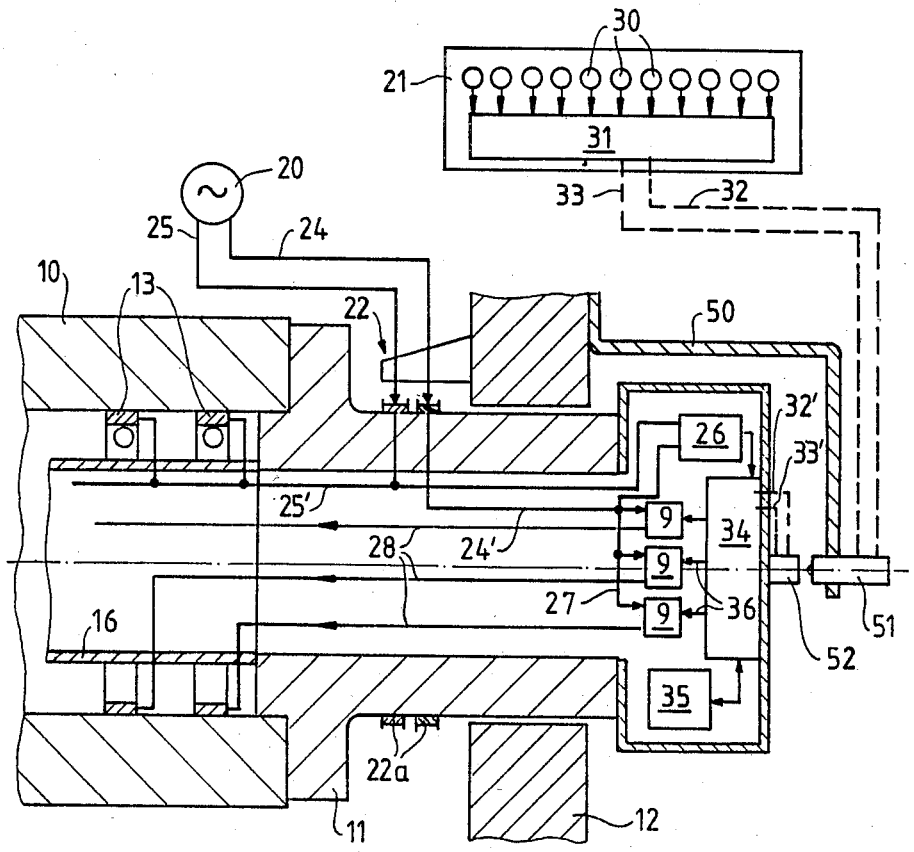
FIG. 3 shows a partial longitudinal section through an embodiment example which differs from that in FIG. 1.

The embodiment shown in FIG. 3 differs from that shown in FIG. 1 substantially only in that elements 51, 52 for contact-free signal transmission are provided instead of slip-rings, for transmitting the serial signal sequence (formed in the converter 31) to the rotating roll body. More specifically, an emitter 51 (e.g. a lamp) is attached to a holder 50 so that it can send out signals (e.g. light signals) in the axis of the roll. On the control unit 23 which rotates with the roll body a receiver 52 which picks up the signals (e.g. a photocell) is disposed coaxial with the roll body. The lines 32 and 33 connect the parallel-serial converter 31 with the emitter 51. The lines 32' and 33' connect the receiver 52 with the serial-parallel converter 34. Thus, no slip-rings are required, other than the slip-rings 22*a* for all the heating current.

Figure 4:
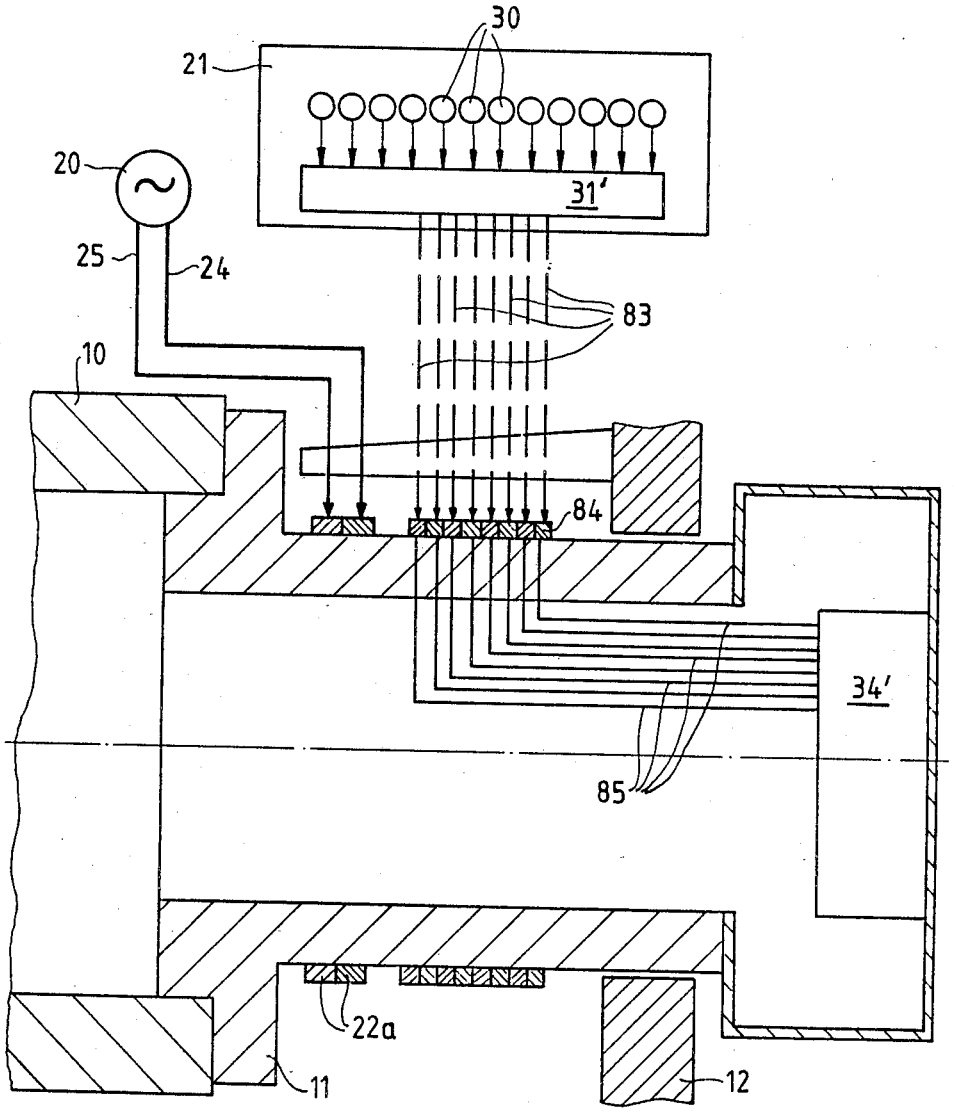
FIG. 4 shows a partial longitudinal section through a further embodiment example derived from FIG. 1.

According to FIGS. 1 and 3, only one single serial signal sequence is used for transmitting the control signals to the rotating roll body. Although this method is somewhat slower than the normal parallel signal transmission, the transmission speed will generally suffice for paper machine rolls. However, if a higher transmission speed should be desired, the embodiment shown in FIG. 4 could be used. FIG. 4 shows only the important parts of the roll body 10, 11, the bearing 12, the heating current supply 20, 24, 25, 22*a*, and the control centre 21. The heating elements 13, the heating output setting device 9 and the associated conductors have been omitted. In the control centre 21 a control signal is again formed for each heating element (with the aid of the respective setting devices 30). These signals are again supplied to a parallel-serial converter 31' which converts the control signals into a plurality of parallel serial signal sequences (eight, for example). These are supplied by means of a corresponding number of lines 83, slip-rings 84 and lines 85 to a serial-parallel converter 34' which rotates with the roll body 10, 11. In this converter 34' the serial signal sequences are converted back again into parallel control signals which are supplied to the individual heating output setting devices as in the first embodiment examples.

Electrically heated rolls are involved in the embodiment examples shown. However, the method according to the invention for solving the problem can also be used on rolls with other heating systems, for example on a roll which can be heated by means of a fluid, like that in U.S. Pat. No. 3,182,587.

I claim:

1. A heatable roll of the kind comprising a tubular, rotatable roll body, a plurality of heating elements distributed internally along the length of the roll, a stationary heating-energy source located externally of the roll body, a main lead disposed in the rotating roll body to which the said heating-energy source is connected via a connecting device, a heating output setting device for each heating element rigidly fixed to the rotating roll body and connected to the main lead, for setting the heating output dependent upon the magnitude of an electrical control signal, and a signal transmitting arrangement to which the heating output setting device are connected, for transmitting the control signals from a control centre located externally of the roll body to the rotating roll body, characterised in that the signal transmitting arrangement comprises at least one serial signal channel, a parallel-serial converter outside the roll body, via which said serial signal channel is connected to said control centre, and a serial-parallel converter inside the roll body, via which said serial signal channel is connected to the heating output setting device.

2. A roll according to claim 1, characterised in that one common serial channel only is provided for all the heating elements.

3. A roll according to claim 1, characterised in that the total number of heating elements is subdivided into a plurality of groups each containing a small number of heating elements, and that a signal channel is provided for each group.

4. A roll according to claim 1, characterised in that the signal transmitting arrangement includes devices for contact-free signal transmission.

5. A roll according to claim 1, and in which the heating elements are constructed as annular electrical heating elements, characterised in that a clamping arrangement is provided for pressing each of the annualar heating elements against the inner surface of the roll body.

6. A roll according to claim 5, characterised in that a supporting member is provided to which the heating elements are attached, said supporting element extending through the inner space defined by the tubular roll body.

7. A roll according to claim 5 or 6, characterised in that, measured parallel to the roll axis, the width of each of the annular heating elements is only a fraction (in the magnitude of 20 to 50%) of the distance between the centres of the heating elements.

8. A roll according to claim 1, characterised in that a plurality of cooling air-jet nozzles are arranged, in a known way, on the outside of the roll casing, said nozzles being disposed at intervals along the length of the roll.

9. A roll according to claim 8, characterised in that a cooling air-jet nozzle is provided for each heating element.

* * * * *